US010159129B2

(12) United States Patent
Kido et al.

(10) Patent No.: US 10,159,129 B2
(45) Date of Patent: Dec. 18, 2018

(54) LIGHTING DEVICE, ILLUMINATION DEVICE, AND ELECTRONIC DEVICE

(71) Applicant: PANASONIC INTELLECTUAL PROPERTY MANAGEMENT CO., LTD., Osaka (JP)

(72) Inventors: Hiroshi Kido, Osaka (JP); Shigeru Ido, Osaka (JP); Hisao Kataoka, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/898,475

(22) Filed: Feb. 17, 2018

(65) Prior Publication Data

US 2018/0255619 A1 Sep. 6, 2018

(30) Foreign Application Priority Data

Mar. 1, 2017 (JP) ..... 2017-038827

(51) Int. Cl.
*H05B 33/00* (2006.01)
*H05B 33/08* (2006.01)
*H05B 37/02* (2006.01)

(52) U.S. Cl.
CPC ..... *H05B 33/0857* (2013.01); *H05B 33/0827* (2013.01); *H05B 33/0845* (2013.01); *H05B 33/0866* (2013.01); *H05B 37/0209* (2013.01)

(58) Field of Classification Search
CPC ..... H05B 37/0272; H05B 37/0227; H05B 33/0872; H05B 37/0281; H05B 33/0854; H05B 37/0218; H05B 33/0803; H05B 37/02; H05B 39/086; H05B 39/088; H05B 33/08; H05B 33/0857; H05B 37/0236; H05B 37/0245
See application file for complete search history.

(56) References Cited

U.S. PATENT DOCUMENTS

2013/0241428 A1 9/2013 Takeda
2014/0191670 A1 7/2014 Ge et al.
2015/0173143 A1 6/2015 Zhang et al.

FOREIGN PATENT DOCUMENTS

JP 2012-150887 A 8/2012

OTHER PUBLICATIONS

Extended European Search Report for corresponding European Application No. 18157307.2 dated Jul. 24, 2018.

*Primary Examiner* — Monica C King
(74) *Attorney, Agent, or Firm* — Renner Otto Boisselle & Sklar, LLP

(57) ABSTRACT

A lighting device which causes a first light source to emit illumination light and a second light source to emit illumination light having a color temperature higher than a color temperature of the illumination light emitted by the first light source includes: an illuminator which includes a first switching element connected in series to the first light source, and a second switching element connected in series to the second light source; an illumination controller which controls the illuminator to place at least one of the first switching element and the second switching element into an off state; and a constant-current controller which detects a sum of values of currents flowing through the first light source and the second light source, and controls the first switching element and the second switching element based on the sum.

20 Claims, 9 Drawing Sheets

LIGHTING DEVICE, ILLUMINATION DEVICE, AND ELECTRONIC DEVICE

CROSS REFERENCE TO RELATED APPLICATION

This application claims the benefit of priority of Japanese Patent Application Number 2017-038827 filed on Mar. 1, 2017, the entire content of which is hereby incorporated by reference.

BACKGROUND

1. Technical Field

The present disclosure relates to a lighting device which causes two light sources to emit light having different color temperatures, an illumination device, and an electronic device.

2. Description of the Related Art

Conventionally, a lighting device which causes light emitting elements to emit light having respective colors has been proposed (for example, see Japanese Unexamined Patent Application Publication No. 2012-150887). The lighting device according to Japanese Unexamined Patent Application Publication No. 2012-150887 includes a plurality of light emitting diodes which emit light having different colors. The values of currents which flow through the light emitting diodes are controlled by constant current circuits connected in series to the light emitting diodes. This control is aimed at maintaining the values of currents which flow through the light emitting diodes at desired values.

SUMMARY

However, independent constant current circuits control the values of currents which flow through the light emitting diodes, in the lighting device according to Japanese Unexamined Patent Application Publication No. 2012-150887. Accordingly, for example, when the same current is supplied to a plurality of light emitting diodes, currents which flow through the light emitting diodes may vary due to, for instance, individual differences of the constant current circuits. Note that in order to eliminate such variation, it is conceivable to detect the intensities of light emitted by the light emitting diodes, and to control currents which flow through the plurality of light emitting elements based on the intensities of the emitted light, yet the configuration of such a lighting device will be complicated.

In view of this, the present disclosure provides a lighting device which can supply desired currents to two light sources which emit light having different color temperatures and has a simplified configuration, and an illumination device and an electronic device each including the lighting device.

In order to achieve such a lighting device, a lighting device according to an aspect of the present disclosure is a lighting device which causes a first light source to emit illumination light and a second light source to emit illumination light having a color temperature higher than a color temperature of the illumination light emitted by the first light source, and includes: an illuminator which includes a first switching element connected in series to the first light source, and a second switching element connected in series to the second light source; an illumination controller which controls the illuminator by outputting a first driving signal and a second driving signal to the first switching element and the second switching element, respectively, to place at least one of the first switching element and the second switching element into an off state; and a constant-current controller which detects a sum of values of currents flowing through the first light source and the second light source, and causes values of currents flowing through the first light source and the second light source when the first light source and the second light source are on to be constant by controlling the first switching element and the second switching element based on the sum.

Furthermore, in order to achieve such an illumination device, an illumination device according to an aspect of the present disclosure includes the above lighting device, and a casing which houses the lighting device.

Furthermore, in order to achieve such an electronic device, an electronic device according to an aspect of the present disclosure includes the above lighting device, and a portable casing which houses the lighting device.

According to the present disclosure, a lighting device which can supply desired electric currents to two light sources which emit light having different color temperatures and has a simplified configuration, and an illumination device and an electronic device each including the lighting device can be provided.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

The following specifically describes a lighting device and an illumination device according to an aspect of the present disclosure, with reference to the drawings.

Note that the embodiments described below each show a particular example of the present disclosure. The numerical values, elements, the arrangement and connection of the elements, and others indicated in the following embodiments are mere examples, and are not intended to limit the present disclosure. In addition, among the elements in the following embodiments, elements not recited in any of the independent claims defining the most generic part of the concept of the present disclosure are described as optional elements.

Note that the drawings are schematic diagrams, and do not necessarily provide strictly accurate illustration. Further, the same numeral is given to substantially the same configuration throughout the drawings, and a redundant description is omitted or simplified.

Embodiment 1

[1-1. Basic Configuration]

First, a description of a lighting device according to Embodiment 1 is given with reference to the drawings.

Figure 1:
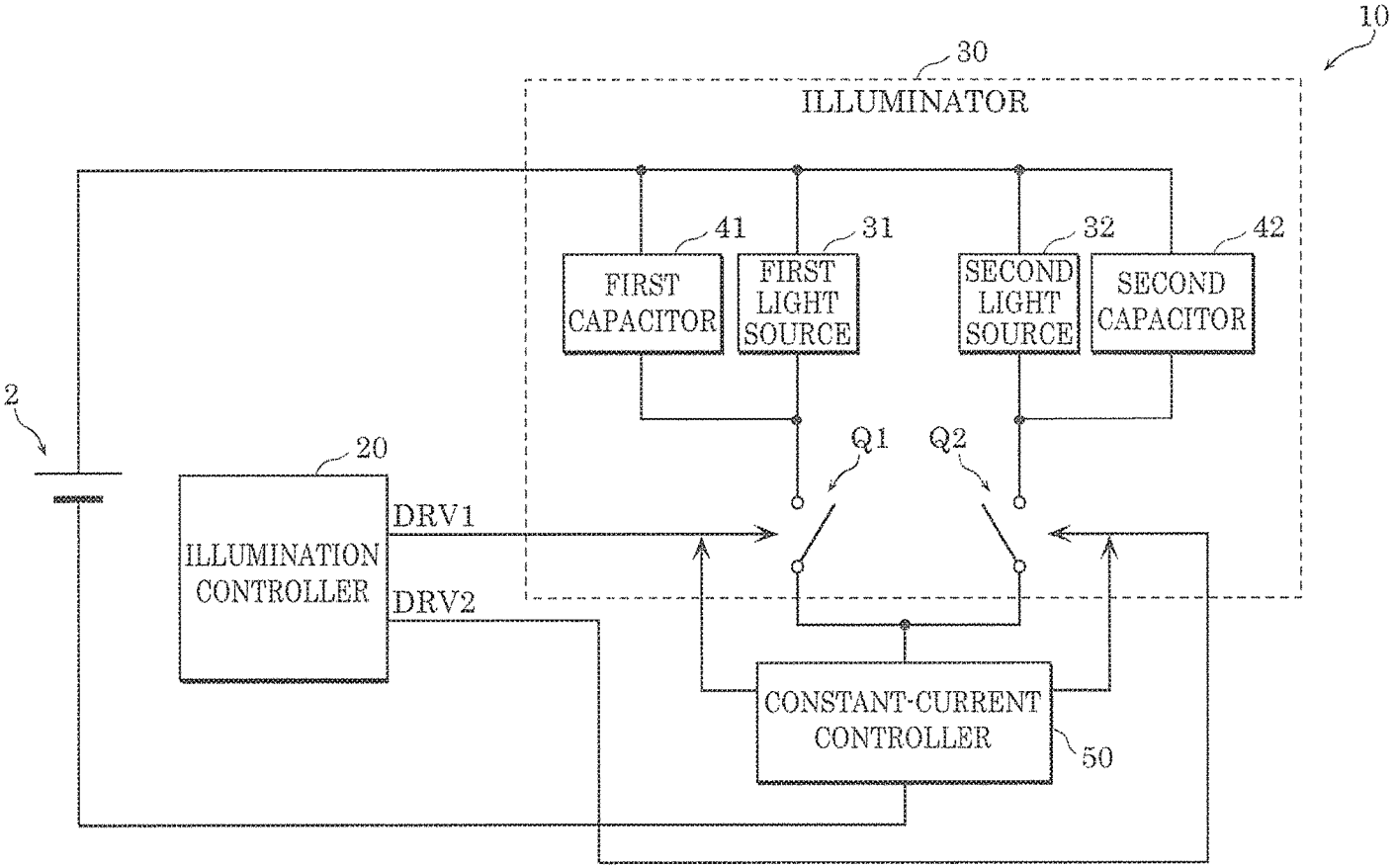
FIG. 1 is a circuit diagram illustrating a basic configuration of a lighting device according to Embodiment 1.

FIG. 1 is a circuit diagram illustrating a basic configuration of lighting device 10 according to the present embodiment. Note that FIG. 1 also illustrates direct-current power supply 2 which supplies power to lighting device 10, in addition to lighting device 10.

As illustrated in FIG. 1, lighting device 10 emits illumination light using power supplied from direct-current power supply 2, and includes illuminator 30, illumination controller 20, and constant-current controller 50. The following describes elements of lighting device 10 and direct-current power supply 2.

[1-1-1. Illuminator]

Illuminator 30 is a circuit which emits illumination light. Illuminator 30 includes: first light source 31; first switching element Q1 connected in series to first light source 31; and first capacitor 41 connected in parallel to first light source 31. Illuminator 30 further includes: second light source 32 which emits light having a color temperature higher than the color temperature of light emitted by first light source 31; second switching element Q2 connected in series to second light source 32; and second capacitor 42 connected in parallel to second light source 32.

First light source 31 emits illumination light having a color temperature lower than the color temperature of illumination light emitted by second light source 32. In the present embodiment, first light source 31 includes light emitting diodes (LEDs) which emit white light having 1500 K or more and less than 3800 K, for example.

Second light source 32 emits illumination light having a color temperature higher than illumination light emitted by first light source 31. In the present embodiment, second light source 32 includes LEDs which emit white light having 4000 K or more and 7100 K or less, for example.

First switching element Q1 and second switching element Q2 are connected in series to first light source 31 and second light source 32, respectively. Illumination controller 20 periodically switches each of the switching elements between the on and off states at a predetermined duty cycle. Specifically, illumination controller 20 performs pulse width modulation (PWM) control on first switching element Q1 and second switching element Q2. One of the switching elements may be constantly maintained in the on state, and the other may be constantly maintained in the off state. As described above, the duty cycles of the switching elements are controlled by illumination controller 20, whereby the averages (time averages) of currents flowing through the light sources connected in series to the switching elements can be adjusted.

The switching elements are switched between the on and off states at such a high frequency that a person cannot perceive, by visual observation, blinking caused by turning on and off the light sources due to the switching. A frequency at which the on and off states are switched, that is, an operating frequency for PWM control is, for example, 300 Hz or higher.

First switching element Q1 and second switching element Q2 are not limited in particular as long as the on and off states of first switching element Q1 and second switching element Q2 can be periodically switched at predetermined duty cycles. For example, metal-oxide semiconductor field-effect transistors (MOSFETs) can be used as first switching element Q1 and second switching element Q2.

First capacitor 41 and second capacitor 42 are elements connected in parallel to first light source 31 and second light source 32, respectively. The capacitors are connected in parallel to the light sources, whereby currents flowing through the light sources can be smoothed. Characteristics of the capacitors such as capacity may be determined as appropriate according to, for instance, voltages and currents applied to the light sources.

In illuminator 30, a series circuit which includes first light source 31 and first switching element Q1 and a series circuit which includes second light source 32 and second switching element Q2 are connected in parallel. Direct-current power supply 2 applies a direct current voltage to a circuit in which constant-current controller 50 and illuminator 30 having such a configuration are connected in series. Accordingly, a current according to a signal from illumination controller 20 is supplied to illuminator 30, and the light sources emit light.

[1-1-2. Illumination Controller]

Illumination controller 20 is a processing unit which controls illuminator 30. Illumination controller 20 controls illuminator 30 to place at least one of first switching element Q1 and second switching element Q2 into the off state. Illumination controller 20 controls first switching element Q1 and second switching element Q2 by outputting first driving signal DRV1 and second driving signal DRV2 to first switching element Q1 and second switching element Q2, respectively, to periodically switch between the on and off states of the switching elements at predetermined duty cycles (duty cycles). In other words, illumination controller 20 performs PWM control on first switching element Q1 and second switching element Q2. Illumination controller 20 controls illuminator 30 in such a manner, whereby the averages of currents (time averages of currents) supplied to first light source 31 and second light source 32 can be adjusted to desired values. Accordingly, illumination controller 20 can control light emitted by first light source 31 and second light source 32. Here, first light source 31 and second light source 32 emit light having different color temperatures. As described above, the on and off states of the switching elements are switched at such a high frequency that a person cannot perceive blinking by visual observation. Accordingly, illumination light from lighting device 10 appears to a person as mixed light of illumination light from first light source 31 and illumination light from second light source 32. Accordingly, as described above, the color temperature of illumination light from lighting device 10 can be adjusted by separately controlling light from first light source 31 and light from second light source 32. Thus, the color of illumination light from lighting device 10 can be adjusted.

Illumination controller 20 may constantly maintain one of the switching elements in the on state, and may constantly maintain the other switching element in the off state.

Illumination controller 20 is achieved by a microcomputer (MCU; micro-controller unit), for example. A microcomputer is a single-chip integrated circuit which includes, for instance, ROM in which programs are stored, RAM, a processor (CPU; central processing unit) which executes the programs, a timer, and an input output circuit that includes an A/D converter and a D/A converter. Note that illumination controller 20 may be achieved using electric circuits other than a microcomputer.

[1-1-3. Constant-Current Controller]

Constant-current controller 50 is a circuit which causes currents which flow through first light source 31 and second light source 32 when the light sources are on to be constant. Constant-current controller 50 detects a sum of currents flowing through first light source 31 and second light source 32, and causes, by controlling first switching element Q1 and second switching element Q2 based on the sum, the values of currents flowing through first light source 31 and second light source 32 when the light sources are on to be constant. Constant-current controller 50 is connected in series to illuminator 30, and thus the currents flowing through first light source 31 and second light source of illuminator 30 flow through constant-current controller 50. Constant-current controller 50 detects a sum of values of currents flowing through first light source 31 and second light source 32, and causes the averages of currents which flow through the light sources to be constant.

Here, when lighting device 10 is on, only one of first light source 31 and second light source 32 is on, and thus the detected sum of current values corresponds to a value of a current flowing through one of first light source 31 and second light source 32. Accordingly, the values of currents flowing through first light source 31 and second light source 32 can be detected using one current detector 70. This simplifies circuitry of lighting device 10. Furthermore, the values of currents flowing through the light sources are detected using one current detector 70, and thus the relative magnitude relation of the values of currents flowing through the light sources can be more accurately detected, compared to when the values of currents flowing through the two light sources are detected using different current detectors. Consequently, desired currents can be supplied to the light sources. Accordingly, the intensity ratio of illumination light from the light sources can be accurately detected, and thus the color temperature of illumination light emitted from lighting device 10 can be accurately controlled. Further, the capacitors are connected in parallel to the light sources, whereby currents which flow through the light sources can be smoothed. This improves the accuracy of detection of currents by current detector 70, and thus ripples of the intensity of the illumination light from lighting device 10 can be reduced. Accordingly, the flicker of lighting device 10 can be reduced.

Constant-current controller 50 is achieved using a sense resistor for current detection, and a transistor, for example.

[1-1-4. Direct-Current Power Supply]

Direct-current power supply 2 supplies direct-current (DC) power to lighting device 10. Direct-current power supply 2 is achieved using a power supply circuit which includes a rectifier circuit and a DC to DC converter, for example. Alternating-current (AC) power is supplied to the power supply circuit from a system power source such as a commercial power source, for example. The rectification circuit of the power supply circuit converts the supplied AC power into DC power by rectification. The DC to DC converter of the power supply circuit converts DC power supplied from the rectifier circuit into DC power which has a voltage and a current suitable for lighting device 10. Note that direct-current power supply 2 is not limited to the above power supply circuit. Direct-current power supply 2 may be a dry battery, a secondary battery, or the like, for example.

[1-2. Example of Configuration]

The following describes an example of a specific configuration of lighting device 10 according to the present embodiment, with reference to the drawings.

Figure 2:
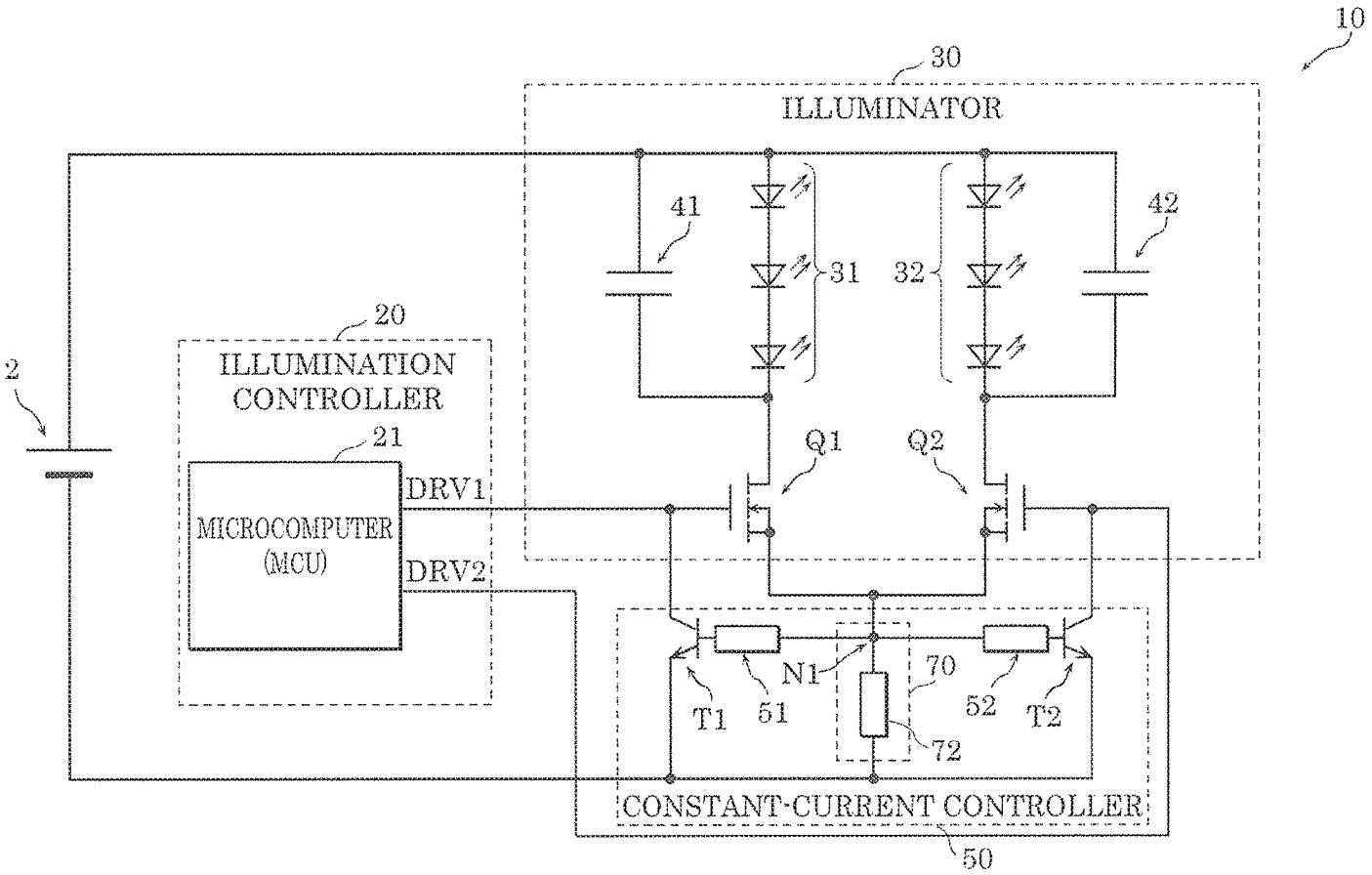
FIG. 2 is a circuit diagram illustrating an example of a specific configuration of the lighting device according to Embodiment 1.

FIG. 2 is a circuit diagram illustrating an example of a specific configuration of lighting device 10 according to the present embodiment. FIG. 2 illustrates specific circuitry of illuminator 30, illumination controller 20, and constant-current controller 50 of lighting device 10.

As illustrated in FIG. 2, first light source 31 and second light source 32 of illuminator 30 each include three LEDs connected in series. Note that the number of LEDs included in each of the light sources and how the LEDs are connected are not particularly limited. For example, the light sources may each include a large number of LEDs connected in series and in parallel. Note that color temperatures of light emitted by the light sources can be adjusted by, for example, appropriately selecting colors of light emitted from LED chips included in the LEDs and compositions of phosphors which convert wavelengths of the emitted light, for instance.

In the exemplary embodiment, N-channel MOSFETs are used as first switching element Q1 and second switching element Q2 of illuminator 30. The source terminals of first switching element Q1 and second switching element Q2 are connected to node N1 illustrated in FIG. 2. The drain terminals of first switching element Q1 and second switching element Q2 are connected to first light source 31 and second light source 32, respectively. When a high-level driving signal is input to the gate terminal of a switching element, the switching element is placed into the on state. Thus, the drain terminal and the source terminal of the switching element are placed into a conductive state. On the other hand, when a low-level driving signal is input to the gate terminal of a switching element, the switching element is placed into the off state. Thus, the drain terminal and the source terminal of the switching element are placed into a non-conductive state.

Illumination controller 20 includes microcomputer 21. Microcomputer 21 outputs first driving signal DRV1 and second driving signal DRV2 to first switching element Q1 and second switching element Q2, respectively. Microcomputer 21 may determine first driving signal DRV1 and second driving signal DRV2, based on, for instance, an internally stored program or may determine first driving signal DRV1 and second driving signal DRV2, based on an input signal from the outside.

Constant-current controller 50 includes current detector 70, resistance elements 51 and 52, first transistor T1, and second transistor T2.

Current detector 70 is connected in series to illuminator 30, and detects a sum of values of currents flowing through first light source 31 and second light source 32. Current detector 70 includes resistance element 72. Resistance element 72 is connected in series to illuminator 30. More specifically, an end of resistance element 72 is connected to illuminator 30 via node N1, and the other end of resistance element 72 is connected to the low-potential output terminal of direct-current power supply 2. Accordingly, currents flowing through first light source 31 and second light source 32 flow into resistance element 72. Thus, a sum of values of currents flowing through first light source 31 and second light source 32 can be detected by detecting a voltage applied to resistance element 72.

Resistance element 51 and resistance element 52 are elements for reducing currents which flow through first transistor T1 and second transistor T2, respectively. An end of resistance element 51 is connected to node N1, and the other end is connected to the base terminal of first transistor T1. An end of resistance element 52 is connected to node N1, and the other end of resistance element 52 is connected to the base terminal of second transistor T2. Resistance element 51 and resistance element 52 each have a resistance sufficiently greater than the resistance of resistance element 72. This prevents excessive currents from flowing through first transistor T1 and second transistor T2.

First transistor T1 and second transistor T2 are elements which control first switching element Q1 and second switching element Q2 so that currents detected by current detector 70 are constant. For example, NPN-type bipolar transistors can be used as first transistor T1 and second transistor T2, as illustrated in FIG. 2. The base terminals of first transistor T1 and second transistor T2 are connected to node N1 via resistance elements 51 and 52, respectively. The emitter terminals of first transistor T1 and second transistor T2 are connected to the low-potential output terminal of direct-current power supply 2. The collector terminal of first transistor T1 is connected to the gate terminal of first switching element Q1, and the collector terminal of second transistor T2 is connected to the gate terminal of second switching element Q2.

[1-3. Operation]

The following describes operation of lighting device 10 according to the present embodiment with reference to the drawings.

FIGS. 3A to 3F are graphs illustrating first to sixth waveform examples of first driving signal DRV1 and second driving signal DRV2 output from illumination controller 20 according to the present embodiment. In FIGS. 3A to 3F, the horizontal axis indicates time and the vertical axis indicates a voltage value.

As illustrated in FIGS. 3A to 3F, illumination controller 20 outputs first driving signal DRV1 and second driving signal DRV2 such that at least one of first driving signal DRV1 and second driving signal DRV2 is at a low level. This places at least one of first switching element Q1 and second switching element Q2 into the off state. Accordingly, currents do not flow through first light source 31 and second light source 32 at substantially the same time, and thus one current detector 70 can detect the value of a current flowing through first light source 31 and the value of a current flowing through second light source 32.

Figure 3A:
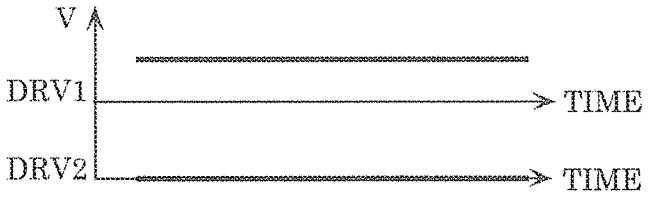
FIG. 3A is a graph showing first waveform examples of a first driving signal and a second driving signal output from an illumination controller according to Embodiment 1.

The first waveform example illustrated in FIG. 3A shows that first driving signal DRV1 steadily maintains the high level, whereas second driving signal DRV2 steadily maintains the low level. In this case, first light source 31 which emits light having a color temperature lower than the color temperature of light emitted by second light source 32 is maintained in the on state, and second light source 32 is maintained in the off state (a relation between the driving signals and operation of the light sources is later described). Accordingly, lighting device 10 emits illumination light having a low color temperature.

Figure 3B:
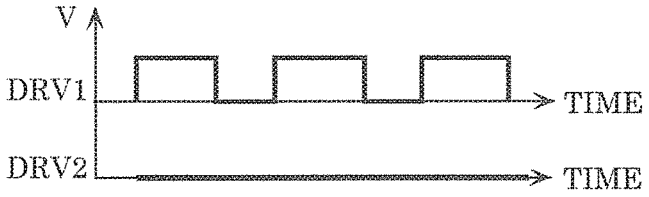
FIG. 3B is a graph showing second waveform examples of the first driving signal and the second driving signal output from the illumination controller according to Embodiment 1.

In the second waveform example illustrated in FIG. 3B, first driving signal DRV1 intermittently changes to the high level, and second driving signal DRV2 steadily maintains the low level. In this case, a current intermittently flows at a predetermined duty cycle through first light source 31 which emits light having a color temperature lower than the color temperature of light emitted by second light source 32, and thus first light source 31 periodically repeats the on state and the off state. A frequency at which first light source 31 periodically repeats the on state and the off state is so high that a person cannot perceive blinking by visual observation. Consequently, the person feels as if lighting device 10 is emitting illumination light having an average of intensities of light from the light sources in the on state and the off state. Stated differently, in this case, a person feels as if lighting device 10 is emitting illumination light having a lower color temperature and an intensity lower than the intensity shown by the first waveform example (average intensity). Here, the intensity of illumination light shown by the second waveform example changes according to the duty cycle of first driving signal DRV1.

Figure 3C:
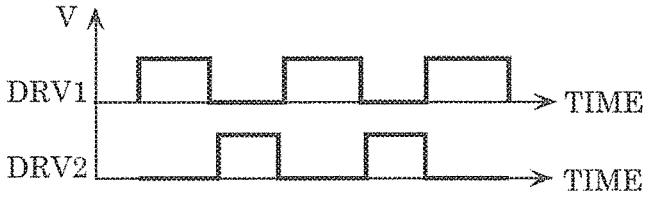
FIG. 3C is a graph showing third waveform examples of the first driving signal and the second driving signal output from the illumination controller according to Embodiment 1.

In the third waveform example illustrated in FIG. 3C, first driving signal DRV1 and second driving signal DRV2 alternately change to the high level. In this case, currents flow through first light source 31 and second light source 32 alternately, and first light source 31 and second light source 32 periodically repeat the on state and the off state. Also in this case, similarly to the case of the second waveform example, a frequency at which the on state and the off state are repeated is so high that a person cannot perceive blinking by visual observation, and thus the person feels as if lighting device 10 is emitting mixed light of illumination light from first light source 31 and illumination light from second light source 32. Stated differently, in this case, the person feels as if lighting device 10 is emitting illumination light having a color temperature between the color temperature of illumination light from first light source 31 and the color temperature of illumination light from second light source 32.

Figure 3D:
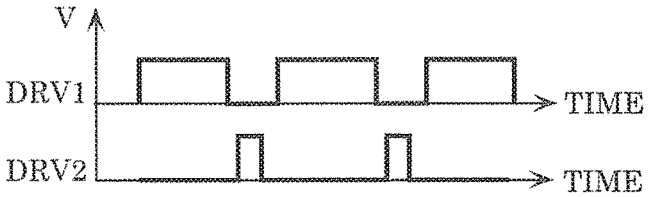
FIG. 3D is a graph showing fourth waveform examples of the first driving signal and the second driving signal output from the illumination controller according to Embodiment 1.

In the fourth waveform example illustrated in FIG. 3D, similarly to the third waveform example, first driving signal DRV1 and second driving signal DRV2 alternately change to the high level. Note that in the fourth waveform example, the duty cycle of first driving signal DRV1 is higher than the duty cycle in the third waveform example, and the duty cycle of second driving signal DRV2 is lower than the duty cycle in the third waveform example. Accordingly, in this case, a proportion of illumination light from first light source 31 among illumination light from lighting device 10 is higher and a proportion of illumination light from second light source 32 among illumination light from lighting device 10 is lower than the proportions in the third waveform example. Thus, in this case, lighting device 10 emits illumination light having a color temperature lower than illumination light emitted in the third waveform example.

Figure 3E:
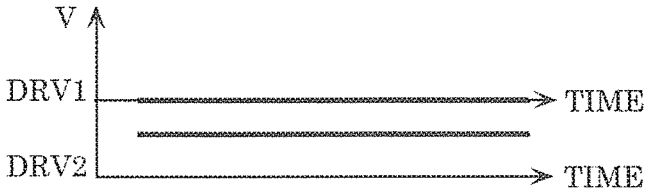
FIG. 3E is a graph showing fifth waveform examples of the first driving signal and the second driving signal output from the illumination controller according to Embodiment 1.

In the fifth waveform example illustrated in FIG. 3E, first driving signal DRV1 steadily maintains the low level, and second driving signal DRV2 steadily maintains the high level. In this case, second light source 32 which emits light having a color temperature higher than the color temperature of light emitted by first light source 31 is maintained in the on state, and first light source 31 is maintained in the off state. Accordingly, lighting device 10 emits illumination light having a high color temperature.

Figure 3F:
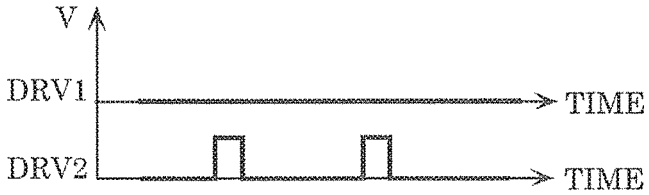
FIG. 3F is a graph showing sixth waveform examples of the first driving signal and the second driving signal output from the illumination controller according to Embodiment 1.

In the sixth waveform example illustrated in FIG. 3F, second driving signal DRV2 intermittently changes to the high level, and first driving signal DRV1 steadily maintains the low level. In this case, a current intermittently flows through second light source 32 which emits light having a color temperature higher than the color temperature of light emitted by first light source 31 at a predetermined duty cycle, and thus second light source 32 periodically repeats the on state and the off state. In this case, a person feels as if lighting device 10 is emitting illumination light having a higher color temperature and a lower intensity (average intensity) than the illumination light emitted in the fifth waveform example. Here, the intensity of illumination light in the sixth waveform example changes according to the duty cycle of second driving signal DRV2.

The following describes in more detail operation of lighting device 10 according to the present embodiment, with reference to the drawings.

Figure 4:
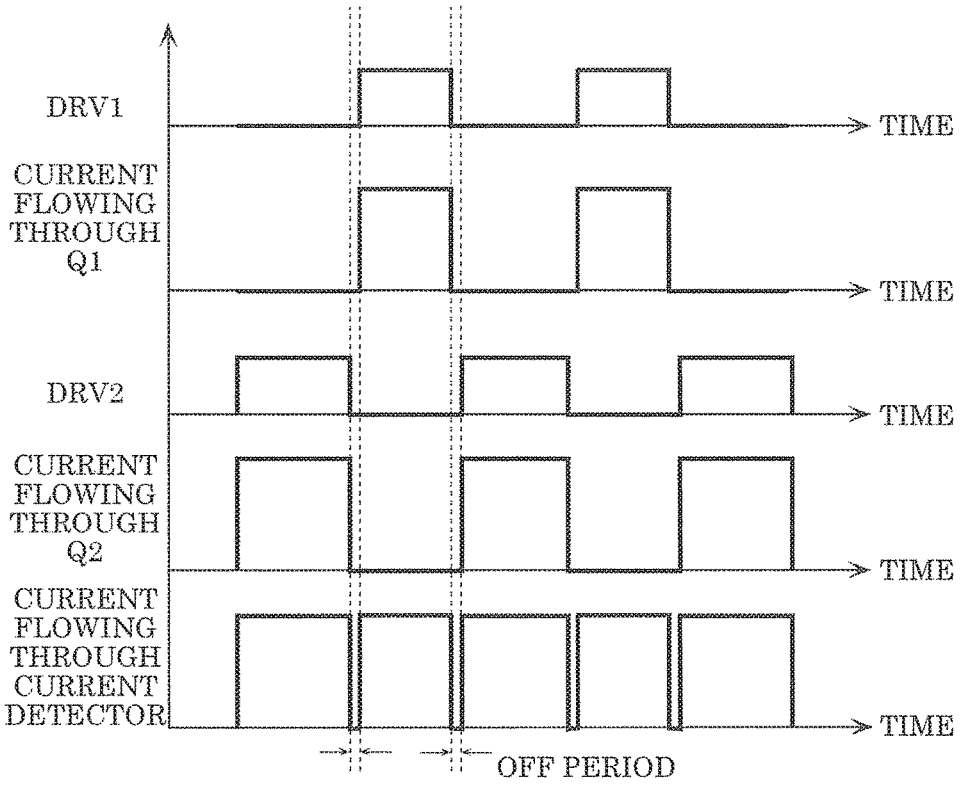
FIG. 4 is a graph showing waveform examples of the first driving signal, the second driving signal, currents flowing through a first switching element and a second switching element, and a current flowing through a current detector, according to Embodiment 1.

FIG. 4 is a graph illustrating waveform examples of first driving signal DRV1 and second driving signal DRV2, currents which flow through first switching element Q1 and second switching element Q2, and a current which flows through current detector 70, according to the present embodiment. In FIG. 4, the horizontal axis indicates time and the vertical axis indicates a voltage value or a current value.

In the waveform example illustrated in FIG. 4, similarly to the third waveform example illustrated in FIG. 3C, first driving signal DRV1 and second driving signal DRV2 alternately change to the high level. For example, when first driving signal DRV1 is at the high level, a current flows from direct-current power supply 2 into first switching element Q1. At this time, a current having the same value as the value of a current flowing through first switching element Q1 also flows through current detector 70. Here, a voltage applied to current detector 70, that is, a voltage that corresponds to a current flowing through first switching element Q1 is applied between the base terminal and the emitter terminal of first transistor T1. Accordingly, the gate voltage of first switching element Q1 is controlled so that a voltage applied between the base terminal and the emitter terminal of first transistor T1 becomes base emitter voltage VBE of first transistor T1. In other words, a voltage applied to current detector 70 is controlled so that the voltage becomes constant. Accordingly, as illustrated in FIG. 4, the values of currents flowing through first switching element Q1 and current detector 70 are controlled so that the values become constant.

Also when second driving signal DRV2 is at the high level, the value of a current which flows through second switching element Q2 is controlled so that the value becomes constant, similarly to the case where first driving signal DRV1 is at the high level.

As described above, in the present embodiment, constant-current controller 50 controls currents which flow through first switching element Q1 and second switching element Q2, that is, currents which flow through first light source 31 and second light source 32 so that the currents become constant. Furthermore, in the present embodiment, first capacitor 41 and second capacitor 42 are connected in parallel to first light source 31 and second light source 32, respectively. Accordingly, currents smoothed by the capacitors are allowed to flow through the light sources.

As described above, currents which flow through the light sources are controlled by first transistor T1 and second transistor T2. Accordingly, the values of currents which flow through the light sources depend on the characteristics of the transistors, and thus when the transistors have a great difference in characteristics, a ratio of the values of currents which flow through the light sources cannot be set to a desired value by control. In view of this, the transistors may have the same characteristics. For example, as such transistors, two transistors formed on one chip may be used. The two transistors formed in such a manner are manufactured in the same process, and thus are given equivalent characteristics. Accordingly, the ratio of values of currents which flow through the light sources can be set to a desired value by control.

In the waveform examples, there is a period when both driving signals are at the low level, that is, a period in which first switching element Q1 and second switching element Q2 are both in the off state, immediately before one of the driving signals changes to the high level. Specifically, illumination controller 20 places first switching element Q1 and second switching element Q2 into the off state immediately before switching one of first switching element Q1 and second switching element Q2 to the on state. This more reliably prevents currents from simultaneously flowing through first switching element Q1 and second switching element Q2.

Lighting device 10 according to the present embodiment can adjust the color of emitted light as describes above, yet the intensity (or illuminance) of illumination light can also be changed without changing the color temperature. The following describes such control aspects with reference to the drawings.

Figure 5:
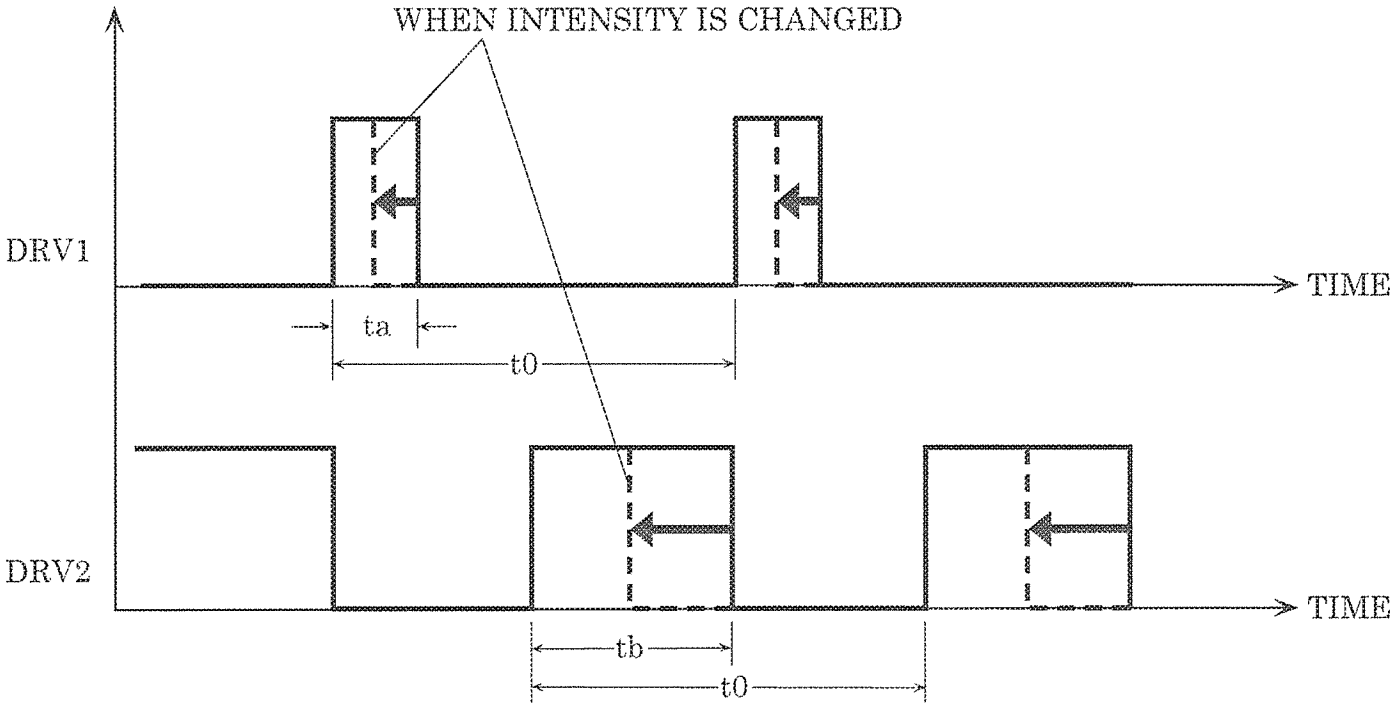
FIG. 5 is a graph showing waveform examples of the driving signals when the intensity of illumination light is changed without changing color temperatures of the illumination light in the lighting device according to Embodiment 1.

FIG. 5 is a graph illustrating waveform examples of driving signals when the intensity of illumination light is changed without changing the color temperature of the illumination light in lighting device 10 according to the present embodiment.

As illustrated in FIG. 5, the duty cycle of first driving signal DRV1 is ta/t0 (=A), and the duty cycle of second driving signal DRV2 is tb/t0 (=B). Here, t0 denotes the operating cycle for PWM control, and ta and tb denote the lengths of the "on" periods of first driving signal DRV1 and second driving signal DRV2, respectively.

In lighting device 10, when the intensity of illumination light is changed without changing the color temperature of the illumination light, duty cycle A of first driving signal DRV1 and duty cycle B of second driving signal DRV2 are changed so that the ratio of duty cycle A of first driving signal DRV1 to duty cycle B of second driving signal DRV2 (A/B=ta/tb) is constant. For example, the duty cycles are decreased as shown by the waveforms of the dashed lines in FIG. 5. Accordingly, the intensity of illumination light can be reduced, without changing the color temperature of the illumination light.

[1-4. Conclusion]

As described above, lighting device 10 according to the present embodiment is a lighting device which causes first light source 31 to emit illumination light and second light source 32 to emit illumination light having a color temperature higher than a color temperature of the illumination light emitted by first light source 31, and includes: illuminator 30 which includes first switching element Q1 connected in series to first light source 31, and second switching element Q2 connected in series to second light source 32. Lighting device 10 further includes illumination controller 20 which controls illuminator 30 by outputting first driving signal DRV1 and second driving signal DRV2 to switching element Q1 and second switching element Q2, respectively, to place at least one of first switching element Q1 and second switching element Q2 into an off state. Lighting device 10 further includes constant-current controller 50 which detects a sum of values of currents flowing through first light source 31 and second light source 32, and causes values of currents flowing through first light source 31 and second light source 32 when first light source 31 and second light source 32 are on to be constant by controlling first switching element Q1 and second switching element Q2 based on the sum.

This turns on only one of first light source 31 and second light source 32 when lighting device 10 is on, and thus a sum of detected current values corresponds to a value of a current which flows through one of first light source 31 and second light source 32. Accordingly, values of currents which flow through first light source 31 and second light source 32 can be detected using one current detector 70. Consequently, the circuitry of lighting device 10 can be simplified. Furthermore, the values of currents which flow through light sources are detected using one current detector 70, and thus a relative magnitude relation of the values of currents which flow through light sources can be more accurately detected, compared to the case where the values of currents which flow through two light sources are detected using separate current detectors. In other words, desired currents can be supplied to the light sources. Accordingly, the intensity ratio of illumination light from the light sources can be accurately detected, and thus the color temperature of illumination light emitted from lighting device 10 can be accurately controlled.

In lighting device 10 according to the present embodiment, illumination controller 20 may perform pulse width modulation (PWM) control on first switching element Q1 and second switching element Q2.

Accordingly, the values of currents which flow through first light source 31 and second light source 32 can be adjusted to desired values. Accordingly, illumination controller 20 can control light emitted by first light source 31 and light emitted by second light source 32. Further, first light source 31 and second light source 32 emit light having different color temperatures, and thus the color temperature of illumination light from lighting device 10 can be adjusted by individually controlling light emitted by first light source 31 and light emitted by second light source 32.

In lighting device 10 according to the present embodiment, an operating frequency for the PWM control may be at least 300 Hz.

This prevents a person from perceiving, by visual observation, blinking caused by turning on and off the light sources due to switching between placing the switching elements into the on state and the off state.

In lighting device 10 according to the present embodiment, illuminator 30 may further include first capacitor 41 connected in parallel to first light source 31, and second capacitor 42 connected in parallel to second light source 32.

Accordingly, currents which flow through light sources can be smoothed. This improves the accuracy of current detection by current detector 70, and thus ripples of the intensity of illumination light from lighting device 10 can be reduced. Accordingly, the flicker of lighting device 10 can be reduced.

In lighting device 10 according to the present embodiment, illumination controller 20 may place first switching element Q1 and second switching element Q2 into the off state, immediately before switching one of first switching element Q1 and second switching element Q2 to an on state.

This more reliably prevents currents from simultaneously flowing through first switching element Q1 and second switching element Q2.

In lighting device 10 according to the present embodiment, illumination controller 20 maintains, at a constant ratio, a ratio of the duty cycle of the PWM signal to be output to first switching element Q1 to the duty cycle of the PWM signal to be output to second switching element Q2.

Accordingly, in lighting device 10, the intensity of illumination light can be changed without changing the color temperature of the illumination light.

Embodiment 2

Next, a lighting device according to Embodiment 2 is to be described. The lighting device according to the present embodiment is different from lighting device 10 according to Embodiment 1 in that driving signals output from an illumination controller to switching elements are corrected based on a detected sum of the values of currents flowing through a first light source and a second light source. The following describes the lighting device according to the present embodiment with reference to the drawings, focusing on differences from lighting device 10 according to Embodiment 1.

Figure 6:
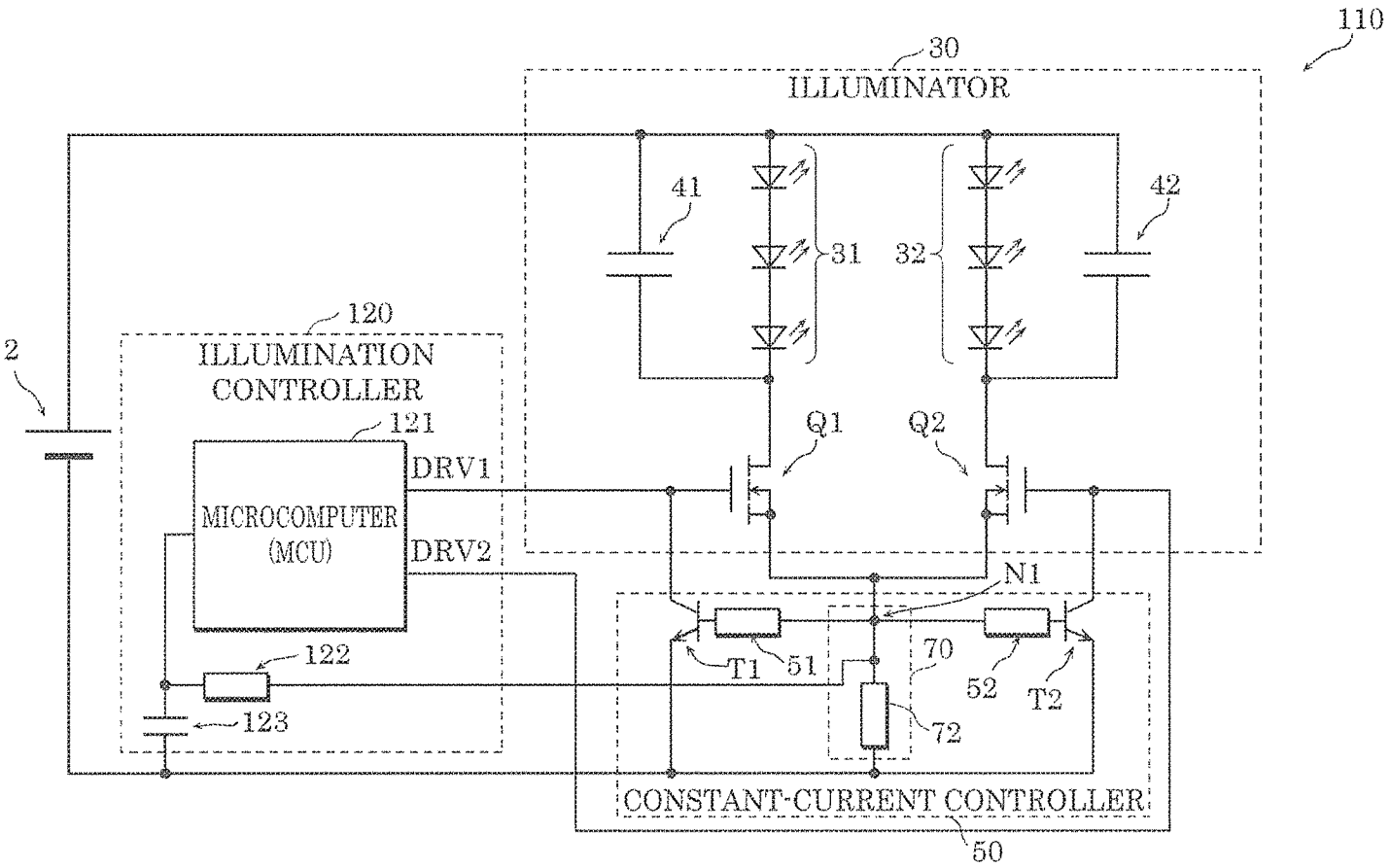
FIG. 6 is a circuit diagram illustrating an example of a specific configuration of a lighting device according to Embodiment 2.

FIG. 6 is a circuit diagram illustrating an example of a specific configuration of lighting device 110 according to the present embodiment.

As illustrated in FIG. 6, lighting device 110 according to the present embodiment includes illuminator 30, illumination controller 120, and constant-current controller 50, similarly to lighting device 10 according to Embodiment 1.

Illumination controller 120 according to the present embodiment includes resistance element 122, third capacitor 123, and microcomputer 121.

Resistance element 122 is inserted in a circuit which connects node N1 and microcomputer 121, and reduces a current which flows through node N1 into microcomputer 121. The resistance of resistance element 122 is sufficiently greater than the resistance of resistance element 72 of constant-current controller 50. As described above, an end of resistance element 122 is connected to node N1, and the other end of resistance element 122 is connected to the input terminal of microcomputer 121. Accordingly, a voltage having a value that corresponds to a sum of the values of currents flowing through first light source 31 and second light source 32, which has been detected by current detector 70, can be input to microcomputer 121. The other end of resistance element 122 is also connected to an electrode of third capacitor 123. Accordingly, a voltage input to microcomputer 121 can be smoothed.

Third capacitor 123 is an element for smoothing a voltage input to microcomputer 121. The one electrode of third capacitor 123 is connected to the input terminal of microcomputer 121 and the other end of resistance element 122, and the other electrode of third capacitor 123 is connected to the low-potential output terminal of direct-current power supply 2.

Similarly to microcomputer 21 according to Embodiment 1, microcomputer 121 outputs first driving signal DRV1 and second driving signal DRV2 to first switching element Q1 and second switching element Q2, respectively. In the present embodiment, microcomputer 121 further corrects the first driving signal and the second driving signal output to first switching element Q1 and second switching element Q2, respectively, based on a sum of the values of currents flowing through first light source 31 and second light source 32. Accordingly, for example, the intensities of illumination light from the light sources can be corrected even in the case where the output from direct-current power supply 2 varies. In the present embodiment, current detector 70 in constant-current controller 50 can detect the sum of such current values, and thus it is not necessary to separately dispose a current detector. Accordingly, the configuration of lighting device 110 can be simplified.

In the present embodiment, a voltage value that corresponds to the sum of such current values is input to microcomputer 121 as an average voltage value smoothed by third capacitor 123. Thus, a signal input to microcomputer 121 is stabilized. Accordingly, microcomputer 121 can stably correct driving signals, based on the average of the sum of such current values.

First driving signal DRV1 and second driving signal DRV2 are PWM signals similarly to driving signals according to Embodiment 1, and microcomputer 121 may change at least one of the duty cycle of first driving signal DRV1 and the duty cycle of second driving signal DRV2, based on the sum of such current values. This allows lighting device 110 to more reliably emit illumination light having a desired intensity and a desired color temperature.

In the present embodiment, illumination controller 120 may limit currents flowing through first light source 31 and second light source 32 when a sum of such current values exceeds a threshold. Here, the threshold is an upper limit of a value of a current which allows lighting device 110 to normally emit light, for example. Accordingly, current detector 70 of constant-current controller 50 can be used for overcurrent detection, and lighting device 110 can be protected when an anomaly occurs in lighting device 110 or direct-current power supply 2. It is not necessary to separately dispose a current detector for overcurrent detection, and thus the configuration of lighting device 110 can be simplified.

Embodiment 3

The following describes a lighting device according to Embodiment 3. The lighting device according to the present embodiment is different from lighting device 110 according to Embodiment 2 in that the loss of power used in an illumination controller can be reduced. The following describes the lighting device according to the present embodiment with reference to the drawings, focusing on differences from lighting device 110 according to Embodiment 2.

Figure 7:
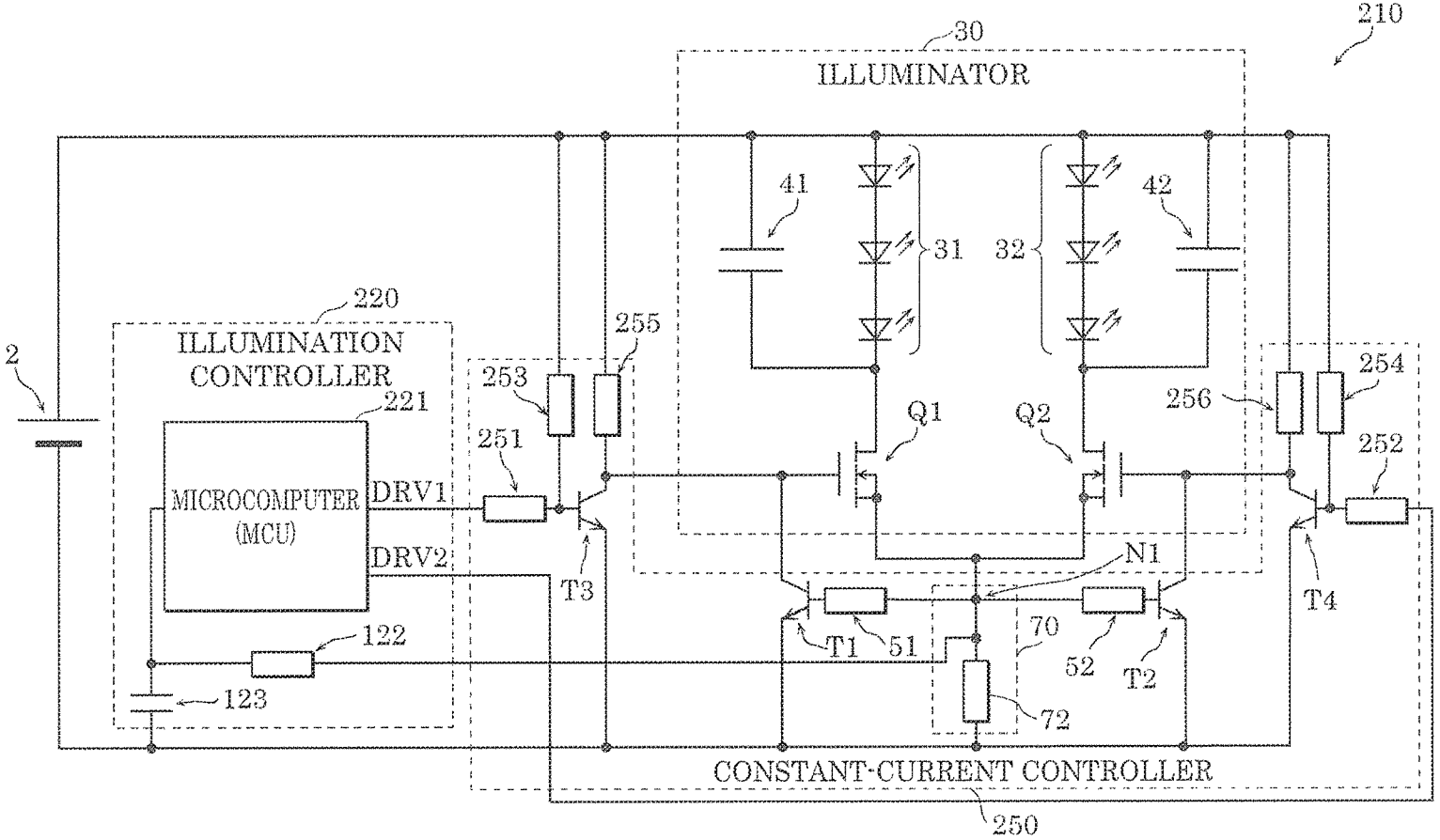
FIG. 7 is a circuit diagram illustrating an example of a specific configuration of a lighting device according to Embodiment 3.
Figure 8:
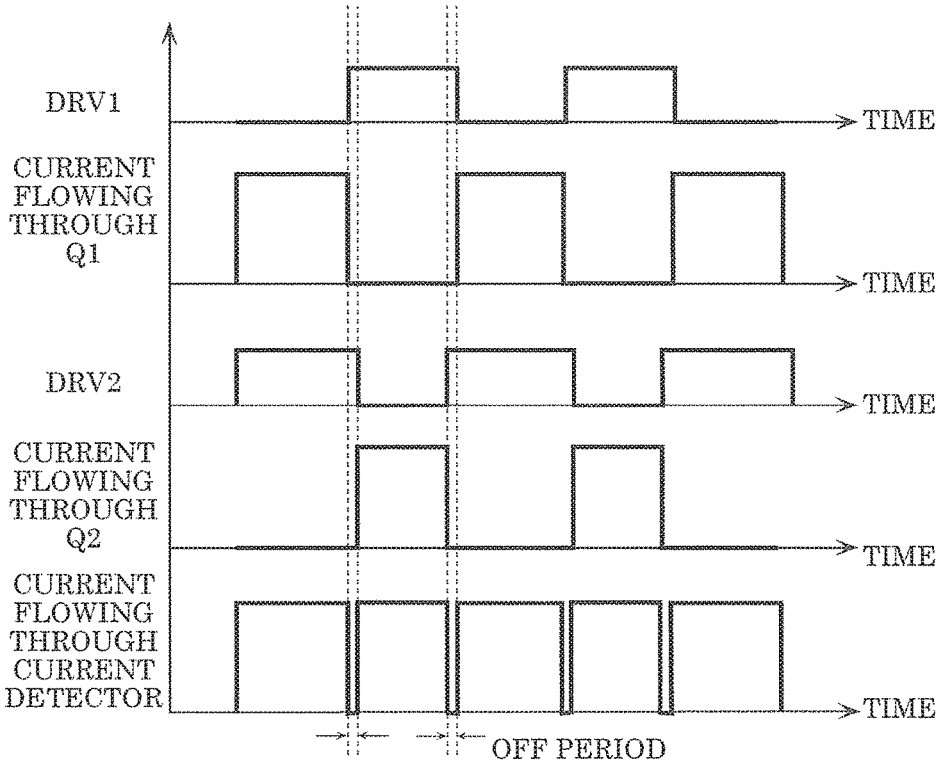
FIG. 8 is a graph showing waveform examples of a first driving signal and a second driving signal, currents flowing through a first switching element and a second switching element, and a current flowing through a current detector, according to Embodiment 3.

FIG. 7 is a circuit diagram illustrating an example of a specific configuration of lighting device 210 according to the present embodiment. FIG. 8 is a graph illustrating waveform examples of first driving signal DRV1 and second driving signal DRV2, currents which flow through first switching element Q1 and second switching element Q2, and a current which flows through current detector 70, according to the present embodiment. In FIG. 8, the horizontal axis indicates time and the vertical axis indicates a voltage value or a current value.

As illustrated in FIG. 7, lighting device 210 according to the present embodiment includes illuminator 30, illumination controller 220, and constant-current controller 250, similarly to lighting device 110 according to Embodiment 2.

Constant-current controller 250 according to the present embodiment further includes third transistor T3, fourth transistor T4, and resistance elements 251 to 256, in addition to constant-current controller 50 according to Embodiment 2.

Third transistor T3 and fourth transistor T4 are elements for inverting levels of first driving signal DRV1 and second driving signal DRV2, respectively. For example, NPN-type bipolar transistors can be used as third transistor T3 and fourth transistor T4, as illustrated in FIG. 7.

The base terminal of third transistor T3 is connected, via resistance element 251, to a terminal of microcomputer 221 through which first driving signal DRV1 is output, and is connected to the high-potential output terminal of direct-current power supply 2 via resistance element 253. The collector terminal of third transistor T3 is connected to the high-potential output terminal of direct-current power supply 2 via resistance element 255, and is connected to the gate terminal of first switching element Q1. The emitter terminal of third transistor T3 is connected to the low-potential output terminal of direct-current power supply 2.

The base terminal of fourth transistor T4 is connected, via resistance element 252, to a terminal of microcomputer 221 through which second driving signal DRV2 is output, and is connected to the high-potential output terminal of direct-current power supply 2 via resistance element 254. The collector terminal of fourth transistor T4 is connected to the high-potential output terminal of direct-current power supply 2 via resistance element 256, and is connected to the gate terminal of second switching element Q2. The emitter terminal of fourth transistor T4 is connected to the low-potential output terminal of direct-current power supply 2.

Constant-current controller 250 has such a circuit configuration, whereby, for example, when first driving signal DRV1 is at the high level, third transistor T3 outputs a low-level signal to the gate terminal of first switching element Q1. On the other hand, third transistor T3 outputs a high-level signal to the gate terminal of first switching element Q1 when first driving signal DRV1 is at the low level. Fourth transistor T4 also inverts the level of second driving signal DRV2, similarly to third transistor T3.

Illumination controller 220 includes microcomputer 221, resistance element 122, and third capacitor 123, similarly to illumination controller 120 according to Embodiment 2. Illumination controller 220 is different from illumination controller 120 in that the levels of driving signals output from microcomputer 221 are inverted. Specifically, microcomputer 221 outputs low-level first driving signal DRV1 when first switching element Q1 is to be placed in the on state, whereas microcomputer 221 outputs high-level first driving signal DRV1 when first switching element Q1 is to be placed in the off state. The same applies to second driving signal DRV2.

According to the configuration of lighting device 210 as described above, when first driving signal DRV1 output from microcomputer 221 is at the low level, the level of the driving signal is inverted by third transistor T3, and thus a high-level signal is input to the gate terminal of first switching element Q1. Accordingly, first switching element Q1 is placed into the on state, and thus a constant current flows through first switching element Q1 (and first light source 31) as illustrated in FIG. 8. On the other hand, when first driving signal DRV1 output from microcomputer 221 is at the high level, a low-level signal is input to the gate terminal of first switching element Q1. This places first switching element Q1 into the off state, and thus a current does not flow through first switching element Q1 (and first light source 31) as illustrated in FIG. 8. The same applies to second driving signal DRV2.

Note that also in lighting device 210 according to the present embodiment, similarly to lighting device 10 according to Embodiment 1, illumination controller 220 may place first switching element Q1 and second switching element Q2 into the off state, immediately before switching one of first switching element Q1 and second switching element Q2 to the on state (see FIG. 8).

As described above, in lighting device 210, when first driving signal DRV1 output from microcomputer 221 is at the low level, first switching element Q1 is placed in the on state. When second driving signal DRV2 output from microcomputer 221 is at the low level, second switching element Q2 is placed in the on state.

Accordingly, lighting device 210 sets driving signals from microcomputer 221 to the low level when lighting device 210 is on, and thus power loss due to microcomputer 221 can be reduced when lighting device 210 is on. For example, in lighting device 10 according to Embodiment 1, microcomputer 21 outputs a high-level driving signal when lighting device 10 is on, whereby a terminal of microcomputer 21 through which a driving signal is output is substantially short-circuited with the low-potential output terminal of direct-current power supply 2 via a bipolar transistor. As described above, in lighting device 10, in a state where a high-level voltage is applied between the terminal of microcomputer 21 through which a driving signal is output and the low-potential output terminal of direct-current power supply 2, these terminals are substantially short-circuited, and thus power loss due to microcomputer 21 when lighting device 10 is on is of a comparatively great amount. On the other hand, lighting device 210 according to the present embodiment outputs a low-level signal from microcomputer 221 when lighting device 10 is on, and thus the terminal of microcomputer 21 through which a driving signal is output and the low-potential output terminal of direct-current power supply 2 are not short-circuited. Accordingly, in lighting device 210, power loss due to microcomputer 221 when lighting device 210 is on can be reduced from the loss caused in lighting device 10.

Lighting device 10 directly drives the switching elements according to driving signals from microcomputer 21, and thus microcomputer 21 uses a comparatively great amount of power to output driving signals. On the other hand, lighting device 210 according to the present embodiment does not directly drive switching elements according to driving signals from microcomputer 221, and thus needs less power to output driving signals than the power used by lighting device 10.

Embodiment 4

The following describes an illumination device according to Embodiment 4.

Figure 9:
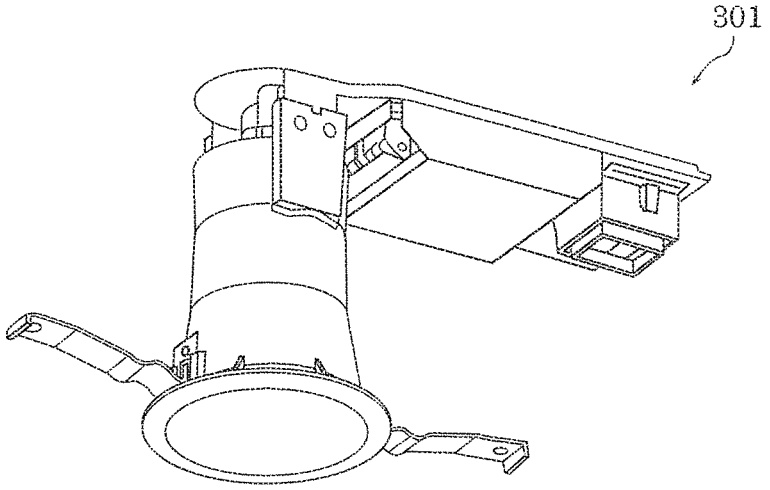
FIG. 9 is an external view of an illumination device according to Embodiment 4.

FIG. 9 is an external view of illumination device 301 according to the present embodiment. Illumination device 301 includes any of the lighting devices according to Embodiments 1 to 3 above, a casing which houses the lighting device, and others. In the present embodiment, illumination device 301 is a downlight.

Illumination device 301 as mentioned above includes any of the lighting devices according to Embodiments 1 to 3 above, and thus can obtain advantageous effects similar to those obtained by the lighting devices according to the above embodiments.

Embodiment 5

The following describes an electronic device according to Embodiment 5.

Figure 10:
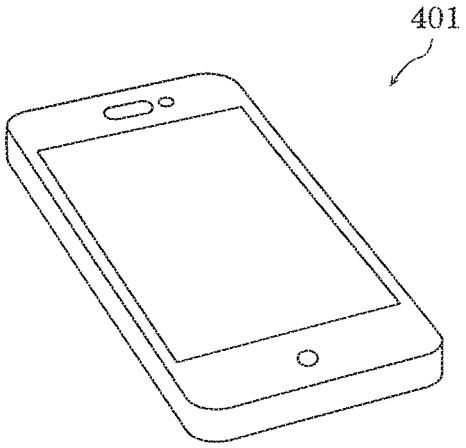
FIG. 10 is an external view of an electronic device according to Embodiment 5.

FIG. 10 is an external view of electronic device 401 according to the present embodiment. Electronic device 401 includes any of the lighting devices according to Embodiments 1 to 3 above, a portable casing which houses the lighting device, and others. In the present embodiment, electronic device 401 is a smartphone. In electronic device 401, a lighting device is used as a light source for illumination included in electronic device 401, for example.

Electronic device 401 as mentioned above includes any of the lighting devices according to Embodiments 1 to 3 above, and thus can obtain advantageous effects similar to those obtained by the lighting devices according to the above embodiments.

OTHERS

The above completes description of the present disclosure based on the embodiments, yet the present disclosure is not limited to the embodiments.

For example, in the above embodiments, first capacitor 41 and second capacitor 42 are connected in parallel to first light source 31 and second light source 32, respectively, yet such capacitors are not essential components. For example, the capacitors may not be used when the output voltage from direct-current power supply 2 is fully stabilized.

The above embodiments have illustrated examples in which first light source 31 and second light source 32 are LEDs, yet the configuration of the light sources is not limited to this. The light sources may be solid light emitting elements, such as organic electro-luminescent (EL) elements, for example.

In the above embodiments, the lighting devices each include two light sources, namely first light source 31 and second light source 32, yet the number of light sources is not limited to two. For example, the lighting devices may each include three or more light sources. Further, the lighting devices may each include three or more switching elements according to the number of light sources.

The present disclosure may also include embodiments as a result of adding various modifications to the embodiments that may be conceived by those skilled in the art, and embodiments obtained by combining elements and functions in the embodiments in any manner as long as the combination does not depart from the scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting device which causes a first light source to emit illumination light and a second light source to emit illumination light having a color temperature higher than a color temperature of the illumination light emitted by the first light source, the lighting device comprising:

an illuminator which includes a first switching element connected in series to the first light source, and a second switching element connected in series to the second light source;

an illumination controller which controls the illuminator by outputting a first driving signal and a second driving signal to the first switching element and the second switching element, respectively, to place at least one of the first switching element and the second switching element into an off state; and a constant-current controller which detects a sum of values of currents flowing through the first light source and the second light source, and causes values of currents flowing through the first light source and the second light source when the first light source and the second light source are on to be constant by controlling the first switching element and the second switching element based on the sum.

2. The lighting device according to claim 1, wherein the illumination controller performs pulse width modulation (PWM) control on the first switching element and the second switching element.

3. The lighting device according to claim 2, wherein an operating frequency for the PWM control is at least 300 Hz.

4. The lighting device according to claim 1, wherein the illuminator further includes a first capacitor connected in parallel to the first light source, and a second capacitor connected in parallel to the second light source.

5. The lighting device according to claim 1, wherein the illumination controller places the first switching element and the second switching element into the off state, immediately before switching one of the first switching element and the second switching element to an on state.

6. The lighting device according to claim 1, wherein the illuminator is connected in series to the constant-current controller.

7. The lighting device according to claim 6, wherein the first driving signal is a pulse width modulation (PWM) signal, the second driving signal is a PWM signal, and the illumination controller changes at least one of a duty cycle of the first driving signal and a duty cycle of the second driving signal, based on the sum.

8. The lighting device according to claim 7, wherein the illumination controller maintains, at a constant ratio, a ratio of the duty cycle of the PWM signal to be output to the first switching element to the duty cycle of the PWM signal to be output to the second switching element.

9. The lighting device according to claim 1, wherein when the sum exceeds a threshold, the illumination controller limits currents which flow through the first light source and the second light source.

10. The lighting device according to claim 1, wherein the illumination controller includes a microcomputer, the first switching element is placed into an on state when the first driving signal is at a low level, the first driving signal being output from the microcomputer, and the second switching element is placed into an on state when the second driving signal is at a low level, the second driving signal being output from the microcomputer.

11. An illumination device, comprising:

the lighting device according to claim 1; and a casing which houses the lighting device.

12. An electronic device, comprising:

the lighting device according to claim 1; and a portable casing which houses the lighting device.

13. A method for controlling a lighting device which causes a first light source to emit illumination light and a second light source to emit illumination light having a color temperature higher than a color temperature of the illumination light emitted by the first light source, and includes an illuminator which includes a first switching element connected in series to the first light source, and a second switching element connected in series to the second light source, the method comprising:

controlling the illuminator by outputting a first driving signal and a second driving signal to the first switching element and the second switching element, respectively, to place at least one of the first switching element and the second switching element into an off state; and detecting a sum of values of currents flowing through the first light source and the second light source, and causing values of currents flowing through the first light source and the second light source when the first light source and the second light source are on to be constant by controlling the first switching element and the second switching element based on the sum.

14. The method according to claim 13, wherein pulse width modulation (PWM) control is performed on the first switching element and the second switching element to cause the values of the currents to be constant.

15. The method according to claim 14, wherein an operating frequency for the PWM control is at least 300 Hz.

16. The method according to claim 13, wherein in controlling the illuminator, the first switching element and the second switching element are placed into the off state, immediately before switching one of the first switching element and the second switching element to an on state.

17. The method according to claim 13, wherein in controlling the illuminator, the first driving signal and the second driving signal are corrected based on the sum.

18. The method according to claim 17, wherein the first driving signal is a pulse width modulation (PWM) signal, the second driving signal is a PWM signal, and in controlling the illuminator, at least one of a duty cycle of the first driving signal and a duty cycle of the second driving signal is changed based on the sum.

19. The method according to claim 18, wherein in controlling the illuminator, a ratio of the duty cycle of the PWM signal to be output to the first switching element to the duty cycle of the PWM signal to be output to the second switching element is maintained at a constant ratio.

20. The method according to claim 13, wherein in controlling the illuminator, currents which flow through the first light source and the second light source are limited when the sum exceeds a threshold.

* * * * *